United States Patent [19]

Buck

[11] Patent Number: 4,709,599

[45] Date of Patent: Dec. 1, 1987

[54] COMPENSATING JAW ASSEMBLY FOR POWER TONGS

[76] Inventor: David A. Buck, 118 Rue Du Pain, Broussard, La. 70518

[21] Appl. No.: 813,516

[22] Filed: Dec. 26, 1985

[51] Int. Cl.[4] ..... B25B 17/00

[52] U.S. Cl. ..... 81/57.18; 81/57.2; 81/57.21

[58] Field of Search ..... 81/57.15, 57.17, 57.18, 81/57.33, 57.36, 57.21, 57.2; 72/431, 433, 434, 422; 188/67; 269/23; 294/902

[56] References Cited

U.S. PATENT DOCUMENTS

| | | | |
|---|---|---|---|
| 1,690,007 | 10/1928 | Greve | 81/57.33 |
| 1,690,008 | 10/1928 | Greve | 81/57.33 |
| 1,876,747 | 9/1932 | Rainsford | 72/82 |
| 3,371,562 | 3/1968 | Kelley | 81/57.18 |
| 3,417,599 | 12/1968 | Burns | 72/431 |
| 3,589,742 | 6/1971 | Flick | 81/57.18 |
| 4,250,773 | 2/1981 | Haynes | 81/57.18 |
| 4,290,304 | 9/1981 | Eckel | 81/57.18 |
| 4,565,081 | 1/1986 | Massee | 72/19 |

FOREIGN PATENT DOCUMENTS

| | | | |
|---|---|---|---|
| 961245 | 1/1975 | Canada | 72/465 |
| 1242598 | 7/1986 | U.S.S.R. | 81/57.18 |

*Primary Examiner*—Lowell A. Larson
*Attorney, Agent, or Firm*—John D. Jeter

[57] ABSTRACT

A pipe die linkage for power tongs has a preloaded spring between a force producing cam follower and pipe die of such strength and preload that the die serrations will be forced to adequately bite into the pipe. Bias resisted overtravel will prevent pipe crushing at high torque levels, as the cam follower is forced more toward the pipe.

4 Claims, 2 Drawing Figures

COMPENSATING JAW ASSEMBLY FOR POWER TONGS

FIELD OF UTILIZATION

Apparatus of this invention will be used in powered pipe tongs commonly used to make up and to break out threaded pipe connections for pipe strings and the like suspended in earth boreholes, more particularly, in oil wells.

RELATED ART

Typical pipe tongs in which the pipe die thrusting apparatus of this invention may be used can be generally defined by U.S. Pat. Nos. 4,084,453, 4,290,304, 4,404,876, and the power tongs of my copending patent application Ser. No. 760,257. Apparatus of this invention can be used in all such power tongs, and, by reference, those patents and applications are made part of this application.

BACKGROUND

Powered pipe tongs have been in use for many years primarily to manipulate threaded pipe connections related to pipe suspended in earth boreholes, mostly oil wells. A powered rotating assembly mounted in a stationary frame rotates the pipe. The torque required to turn the pipe is used to force a pipe gripping die, or dies, into contact with the pipe outer surface.

To transfer torque from a motor to the pipe, an outer ring is driven, and cam surfaces on the outer ring engage cam followers that can move radially toward the pipe. The cam surfaces have an angle that defines the ratio of radial cam follower force and peripheral force. Peripheral forces, in this case, are proportional to torque. Cam followers are directly connected to pipe gripping dies. When the system is in equilibrium, the pipe, dies, cam followers, and cam surfaces rotate in unison.

To rotate the resisting pipe, the outer surface must be gripped. To assure gripping, a brake is applied to an assembly rotationally involving the cam followers and hence the dies, and finally the pipe, as the dies grip the pipe. The brake is not released until the die surfaces have imbedded into the pipe. After brake release, torque transferred to the pipe and radial die forces are related by cam angles.

Cam angles have been the subject of considerable study. Evolution has favored a cam angle of about two degrees to imbed the dies. This cam angle, however, can crush the pipe as full torque is applied. Evolution has further favored a continuous increase in the cam angle, as rotation between cam and follower proceeds. The cam angle may increase to the range of twelve degrees to reduce radial die loads at high torque.

The constantly changing cam angle works very well to imbed the die yet protect the pipe as long as the overall dimension system accommodates the intent. The overall dimension system includes the obvious in the tong system, but also includes the pipe outer diameter. There is no problem with different pipe size ranges; the tong components are changed to accept different size ranges. Small diameter differences, from such as tolerance and wear, within one size range is the problem. If the pipe is oversize, the dies will be forced only by the cam low angles and never will be protected by the higher angles. Conversely, if the pipe is undersize, the dies will not be imbedded by the low angles, and the higher cam angles will allow slip. Both problems may damage pipe.

Some system is needed to always assure imbedded dies but never crush pipe.

OBJECTS

It is therefore an object of this invention to provide powered pipe tong dies and cam driven loading apparatus to permit bias restricted relative motion between cam follower and related pipe dies to prevent cam follower motion from causing the crushing of gripped pipe.

It is another object of this invention to provide pipe tong die and cam follower related force conducting elements with bias resisted overtravel ability to allow die serration imbedding forces to be retained over some range of cam follower travel.

It is still a further object of this invention to provide powered pipe tong pipe gripping die and cam follower linkages with bias restricted overtravel to permit a greater range of gripped pipe diameters without crushing oversize pipe or causing die slippage on undersize pipe.

These and other objects, advantages, and features of this invention will be apparent to those skilled in the art from a consideration of this specification, including the attached drawings and appended claims.

BRIEF DESCRIPTION OF DRAWINGS

In the drawings, wherein like reference characters are used throughout to designage like parts.

DETAILED DESCRIPTION OF DRAWINGS

Powered pipe tongs are well established in the art as shown by the referenced patents and applications. The overall assemblies of power tongs are not detailed herein in the interest of more clearly illustrating the points of novelty of this invention. Power tongs commonly have at least two opposed pipe gripping dies and related die forcing contrivances. Only one of the dies and related elements of each general type will be detailed to avoid needless repetition. In the case of three dies, such as required by my copending application, only one die requires the apparatus of this invention. If all dies are to be compensated, each compensating assembly will be quite similar, and one description is adequate.

The pipe gripping die serrations that reduce the radial force required to adequately hold pipe for turning are subject to frequent damage and considerable wear. The die is, hence, considered an expendable. There are several forms of detachable dies that can be fastened to the die carrier. Once attached, however, the die and immediately attached carrier is structurally a single, movable element. These attachments are not detailed, since they are well established in the art. As often used in the field, the die and immediate metal support may extend to the cam surface and act as a cam follower. A wheel, however, to roll on the cam is commonplace. Such arrangements are anticipated by and are within the scope of the claims.

Figure 1:
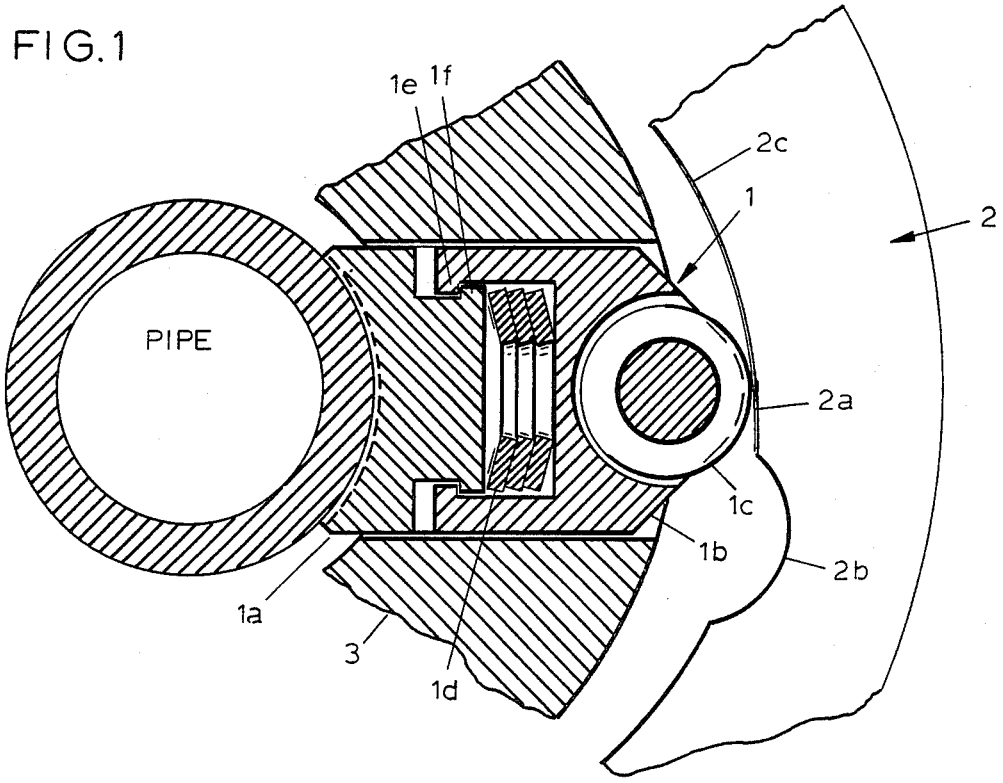
FIG. 1 is a plan view, in partial cutaway, of the preferred embodiment of this invention.

In FIG. 1, the die and forcing assembly 1 comprise die 1*a*, die carrier 1*b*, cam follower 1*c*, and spring 1*d*.

Abutments 1*e* and 1*f* hold the assembly together against the spring preload.

The cam ring 2 is common to power tongs, and is the member usually driven in rotation by a motor. Relief 2*b* allows the die and follower to move radially outward to permit the pipe to be removed from and installed into the gripping and rotating position. A spring (not shown) commonly moves the die and related machinery outward as the relief permits.

When the pipe is in place and torque is to be applied, ring 2 is rotated in the preferred direction, and the cam followers, held briefly from rotation by the die carrier ring 3 by a brake (not shown) encounter the low angle 2*a* of the cam ring 2. This low angle provides enough radial load to the cam follower to start compression of spring 1d. Spring 1d will be so sized and preloaded as to imbed the serrations on the gripping face of the die into the surface of the pipe. As torque is increased to a selected amount, the brake is released, and the higher cam angle 2*c* provides a lowered radial force to torque ratio, and the pipe begins to rotate. As torque further increases, the spring 1*d* allows overtravel to prevent pipe crushing. Means to mount the die carrier on the power tong is the radial guideway in die carrier ring 3 arranged to guide and confine die carrier 1*b* and cam follower 1*c*.

Figure 2:
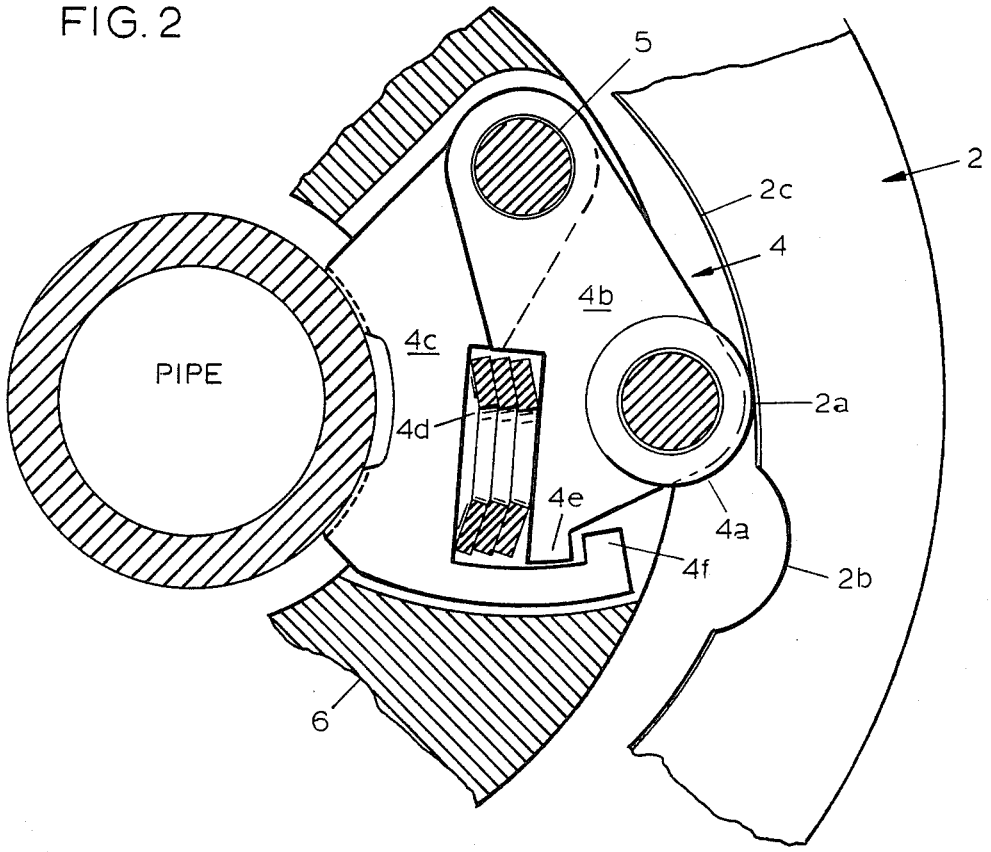
FIG. 2 is a plan view, in partial cutaway, of an alternate embodiment of this invention.

FIG. 2 differs from FIG. 1 in that a different linkage exists between the cam follower and the pipe die. The die and follower assembly 4 rotates about pivot pin 5. The pivot pin is part of die carrier ring 6 and is again controlled in terms of rotation about the pipe by a brake (not shown). As described for FIG. 1, ring 2 is rotated to move cam follower 4*a*, which also moves element 4*b*. A preloaded spring 4*d* transfers load to die 4*c*. The die and follower assembly is held together by lugs 4*e* and 4*f* against the preload of spring 4*d*. Operation for gripping pipe, imbedding the die serrations, and overtravel is the same as for the apparatus of FIG. 1. Means to mount the die and follower assembly 4 on the power tong is the pivot pin 5 secured to die carrier ring 6.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, what is claimed is:

1. An improved pipe gripping assembly for use in powered pipe tongs having:

(a) pipe gripping means mounted on said power tong and arranged to move toward and away from a pipe gripping position;

(b) cam follower means mounted on the power tong and arranged to move said pipe gripping means in response to movement of actuator means of the tong for developing gripping force;

the improvement comprising:

(c) biased overtravel means situated to transmit the principle gripping forces between said pipe gripping means and said cam follower means and to permit bias resisted relative motion therebetween when gripping forces applied to the pipe exceed a preselected amount; and (d) means mounting said pipe gripping means and said cam follower means, for said relative movement, on the pipe tong.

2. The apparatus of claim 1 wherein said mounting means is provided with relative motion stop means to prevent said bias overtravel means from moving said pipe gripping means relative to said cam follower means beyond a preselected distance apart.

3. The apparatus of claim 1 wherein said cam follower means and said pipe gripping means are each mounted on one of a telescoping pair of members situated to move along an axis, said bias overtravel means comprising a spring preloaded in position and situated to extend said telescoping pair of members, and means to limit the extension of said telescoping pair of members.

4. The apparatus of claim 1 wherein said cam follower means is situated to rotate about a pin affixed to said tong, that said pipe gripping means is mounted for rotation about said pin affixed to said tong, and means to limit the amount of bias induced relative movement therebetween.

* * * * *